United States Patent [19]

Tatsumi et al.

[11] 4,239,374

[45] Dec. 16, 1980

[54] ELECTROSTATOGRAPHIC APPARATUS COMPRISING AUTOMATIC DOCUMENT TYPE DETERMINATION MEANS

[75] Inventors: Susumu Tatsumi; Masumi Ikesue; Masao Hosaka; Nobuo Kasahara, all of Tokyo, Japan

[73] Assignee: Ricoh Company, Ltd., Tokyo, Japan

[21] Appl. No.: 967,233

[22] Filed: Dec. 7, 1978

[30] Foreign Application Priority Data

Dec. 29, 1977 [JP] Japan ..... 52-160315

[51] Int. Cl.[3] ..... G03G 15/00

[52] U.S. Cl. ..... 355/14 E; 355/3 DD; 355/10; 355/14 D

[58] Field of Search ..... 355/14 E, 14 D, 3 DD, 355/10, 68, 69, 71

[56] References Cited

U.S. PATENT DOCUMENTS

| | | | |
|---|---|---|---|
| 3,877,413 | 4/1975 | Rowell et al. | 355/14 D |
| 3,914,049 | 10/1975 | Basu et al. | 355/68 |
| 4,050,806 | 9/1977 | Miyakawa et al. | 355/14 D |
| 4,087,171 | 5/1978 | Yano | 355/14 D |
| 4,124,295 | 11/1978 | Gardiner | 355/68 |
| 4,153,364 | 5/1979 | Suzuki et al. | 355/14 E |

*Primary Examiner*—R. L. Moses

*Attorney, Agent, or Firm*—David G. Alexander

[57] ABSTRACT

An image of an original document (16) is sensed to determine if the document (16) is a printed document (the image consists of characters and symbols) or a photographic document. The exposure illumination intensity, developing bias voltage and/or other variable operating parameters are controlled in accordance with the determination.

19 Claims, 11 Drawing Figures

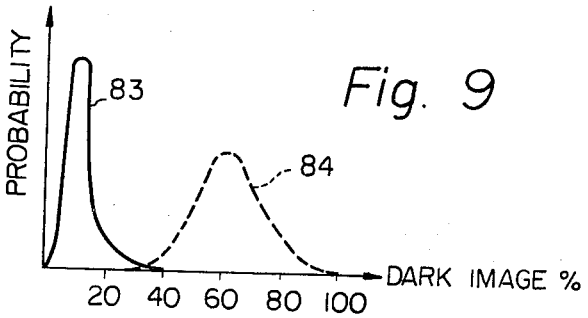
Fig. 9
Fig. 10
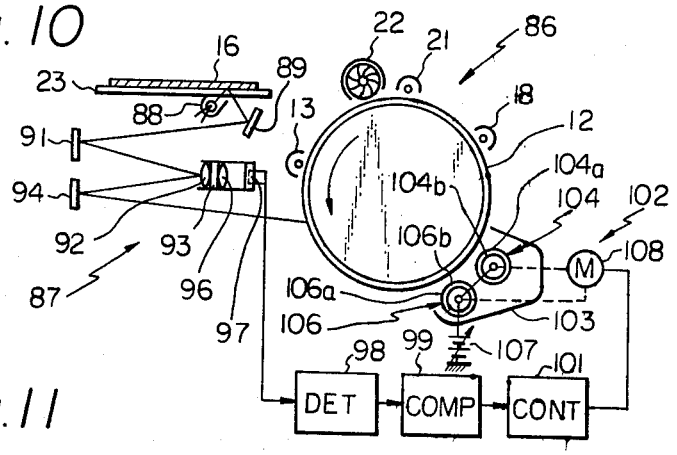
Fig. 11
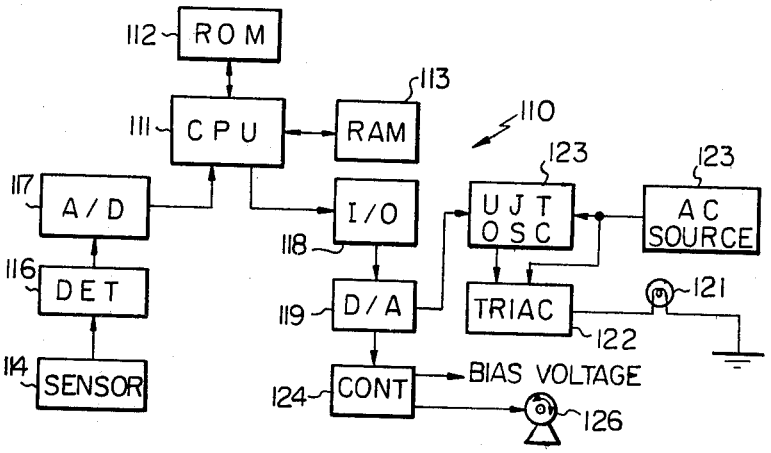

ELECTROSTATOGRAPHIC APPARATUS COMPRISING AUTOMATIC DOCUMENT TYPE DETERMINATION MEANS

BACKGROUND OF THE INVENTION

The present invention relates to an electrostatographic apparatus such as an electrostatic copying machine comprising means for automatically determining whether an original document being reproduced is a printed document or a photographic document and controlling at least one operating parameter of the apparatus such as a developing bias voltage in accordance with the determination.

A fully automatic electrostatic copying machine which is capable of producing satisfactory copies of both printed documents and photographic documents has heretofore not been developed. A printed document is considered to be a document which bears only alphanumeric or other characters, symbols, etc. such as a page of a book. A photographic document is considered to be a document which bears a pictorial scene having various shades of grey in addition to black and white.

Copying machines using the edge effect are able to produce good copies of printed documents, but fail when used for photographic documents since the large dark image areas are lost. Copying machines using a magnetic brush developing unit and automatic bias control produce generally satisfactory copies of photographic documents but poor copies of printed documents since the white background areas appear grey.

It is possible to provide a copying machine having a magnetic brush developing unit with a changeover switch which the operator sets in accordance with the type of documents being copied. The switch controls the developing bias voltage, document illumination intensity, etc. in dependence on the type of document. However, such an arrangement is not entirely satisfactory since it is desired to provide a completely automatic copying machine which does not comprise any manual settings or adjustments.

SUMMARY OF THE INVENTION

An electrostatographic apparatus embodying the present invention includes photoconductive member, imaging means for focussing a light image of an original document onto the photoconductive member to form an electrostatic image and developing means for developing the electrostatic image to form a toner image. Sensor means sense an optical density of the document. Computing means receive an output of the sensor means and determine whether the document is a printed document or a photographic document in accordance with a predetermined criteria. Control means control a variable operating parameter of the apparatus in accordance with a first predetermined function of sensed optical density when the computing means determines that the document is a printed document or a second predetermined function of sensed optical density when the computing means determines that the document is a photographic document.

It is an object of the present invention to provide an electrostatographic apparatus which is capable of producing satisfactory copies of both printed and photographic documents.

It is another object of the present invention to provide a completely automatic copying machine.

It is another object of the present invention to increase the quality of copies of photographic documents over that possible with the prior art.

It is another object of the present invention to provide a generally improved electrostatographic apparatus.

Other objects, together with the foregoing, are attained in the embodiments described in the following description and illustrated in the accompanying drawing.

BRIEF DESCRIPTION OF THE DRAWING

FIG. 9 is another graph illustrating the operation of the present invention;

FIG. 10 is a schematic view of a fourth embodiment of the present invention; and FIG. 11 is a block diagram of a computing means of the present invention.

DESCRIPTION OF THE PREFERRED EMBODIMENTS

While the electrostatographic apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
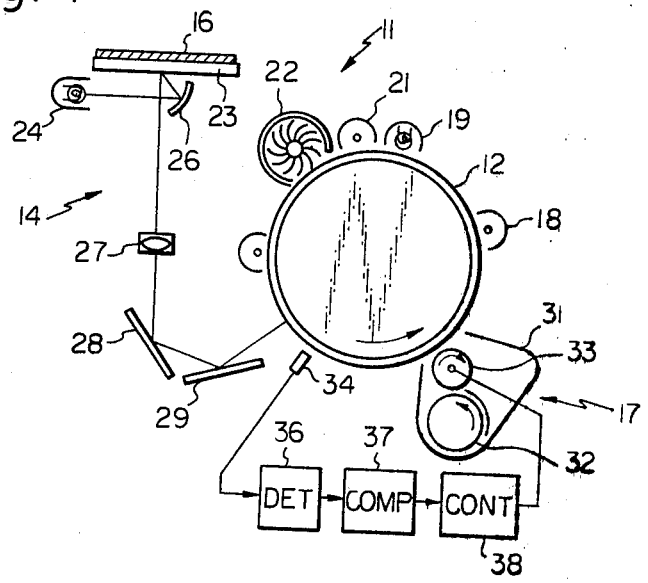
FIG. 1 is a schematic diagram of a first embodiment of the present invention.

Referring now to FIG. 1 of the drawing, an electrostatographic apparatus in the form of an electrostatic copying machine is generally designated by the reference numeral 11 and comprises a photoconductive drum 12 which is rotated counterclockwise at constant speed. A corona charging unit 13 applies an electrostatic charge to the drum 12. An optical system 14 focusses a light image of an original document 16 onto the drum 12 to form an electrostatic image through localized photoconduction. A developing unit 17 applies toner to the drum 12 to develop the electrostatic image into a toner image. A transfer charger 18 transfers the toner image to a copy sheet which is not shown. A fixing unit which is similarly not shown fixes the toner image to the copy sheet to provide a permanent reproduction of the document 16. A lamp 19 illuminates the drum 12 and a discharging unit 21 discharges the drum 12 to eliminate any electrostatic charge therefrom. A cleaning unit 22 removes any residual toner from the drum 12.

The optical system 14 comprises a transparent platen 23 for supporting the document 16 face down. A lamp 24 produces light which is reflected from a mirror 26 onto the document 16 to illuminate a linear portion thereof. A converging lens 27 focusses a light image of the linear portion of the document 16 onto the drum 12 via plane mirrors 28 and 29. Either the platen 23 or optical system 14 is moved to scan the document 16 and progressively form an electrostatic image thereof on the drum 12.

The developing unit 17 comprises a developing tank 31 for containing dry or liquid toner and a roller 32 for applying the toner onto a magnetic brush 33. The magnetic brush 33 is disposed closely adjacent to the drum 12 and applies the toner thereto.

In accordance with the present invention an electrosensor 34 senses the electrostatic potential of the electrostatic image on the drum 12 which is proportional to the optical density of the document 16. The electrosensor 34 is connected to an input of a detector 36 which produces an electrical output signal having a magnitude corresponding to the sensed electrical potential. The output of the detector 36 is fed to a computer 37 which computes a proper developing bias voltage for the magnetic brush 33. The output of the computer 37 is fed to a controller 38 which applies the proper bias voltage to the magnetic brush 33 under control of the computer 37.

Figure 2:
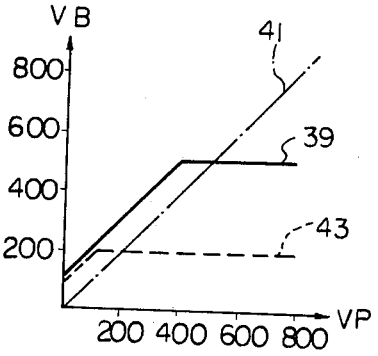
FIGS. 2 and 3 are graphs illustrating the operation of the present invention.

When copying printed documents it is desirable to apply a bias voltage which is slightly higher than the lowest sensed electrostatic potential to the magnetic brush 33 to ensure that background areas will print white. The computer 37 selects the lowest output voltage of the detector 36 which corresponds to the minimum optical density of the document (background area density) and uses this value to compute the bias voltage. For printed documents, the bias voltage is controlled in accordance with a curve 39 in FIG. 2. The bias voltage VB is equal to the background potential VP plus 100 volts with an upper limit of 500 volts. A curve 41 is included for comparison and illustrates the voltages VP and VB being equal.

Figure 3:
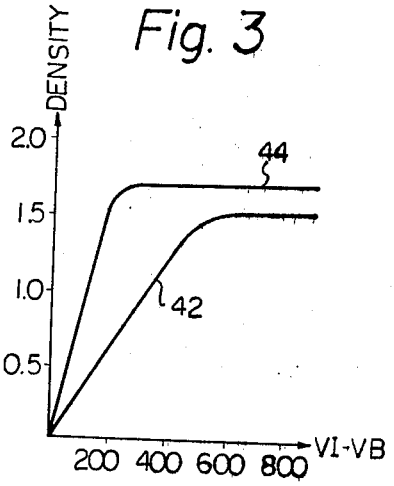

Whereas the curve 39 will produce good copies of printed documents due to the edge effect, control of the copying machine 11 in accordance with the curve 39 will produce copies of photographic documents in which large dark image areas are washed out or lost. This effect is illustrated in FIG. 3 by a curve 42 which plots the electrostatic contrast VI-VB against the optical density of the produced copies. The parameter VI is the electrostatic potential on the drum 12 at a particular point. In other words, the electrostatic contrast which determines the force attracting toner to the drum 12 is equal to the difference between the electrostatic image potential and the bias voltage.

For photographic document having an optical density exceeding 0.5 in all sensed areas the bias voltage VB will be set to the maximum value, 500 volts. For a dark image area having a potential of VI=800 volts, the electrostatic contrast will be only 300 volts. This will produce an optical copy density of only 0.8. Thus, the dark area will appear washed out.

This problem may be overcome by limiting the bias voltage to 200 volts, as illustrated by a curve 43 in FIG. 3. This will produce a characteristic illustrated by a curve 44 in FIG. 3. The same dark image area having an electrostatic potential VI=800 volts will produce an electrostatic contrast of 600 volts and a copy density of about 1.7. Thus, the dark image area will be reproduced with sufficient density. However, limiting the bias voltage VB to 200 volts will produce copies of printed documents having grey backgrounds. In other words, neither of the curves 39 and 43 is suitable for producing good copies of both printed and photographic documents. The curve 42 is suitable, for example, for a dark line on a printed document having an optical density of 1.9 and a width of 0.5 mm. The curve 43 is suitable for a dark image area of a photographic document having the same optical density of 1.9 but the shape of a square having an edge length of 50 mm.

Figure 4:
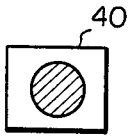
FIG. 4 is a schematic view of a first type of sensor.
Figure 5:
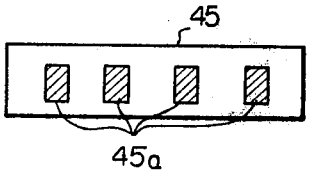
FIG. 5 is a schematic view of a second type of sensor.

The electrosensor 34 may be embodied by a single electrode element as indicated at 40 in FIG. 4 or by an array 45 of electrode elements **45*a* as illustrated in FIG. 5. Where the array 45 is used the electrodes 45*a* are arranged in a row parallel to the axis of the drum 12 and are connected individually to the detector 36**.

In accordance with the present invention, the computer 37 is constructed to sense the output of the detector 36 and determine whether the document 16 is a printed document or a photographic document in accordance with a predetermined criteria. Where the document 16 is determined to be a printed document, the developing bias voltage VB is limited to 500 volts. Where the document 16 is determined to be a photographic document, the developing bias voltage VB is limited to 200 volts.

Generally, the dark image areas on printed documents will have lengths between 0.1 mm and several tens of millimeters. The average dark image area length will generally less than a few millimeters. However, the dark image areas of photographic documents generally have lengths of several tens of millimeters, although some such image areas may have lengths of less than 0.5 mm. Thus, the average length of dark image areas is greater for photographic documents than for printed documents.

The computer 37 obtains the length of a dark image area by measuring the length of time the sensed potential is above, for example, 500 volts. The average dark image area length may be obtained by computing the sum of the lengths of all of the sensed dark image areas and dividing the sum by the number of sensed dark image areas. If desired, a weighting criteria may be applied to the summation. The document 16 is determined to be a printed document if the average dark area length is below a predetermined value such as 8 mm or a photographic document if the average dark image area length is above the predetermined value.

Figure 6:
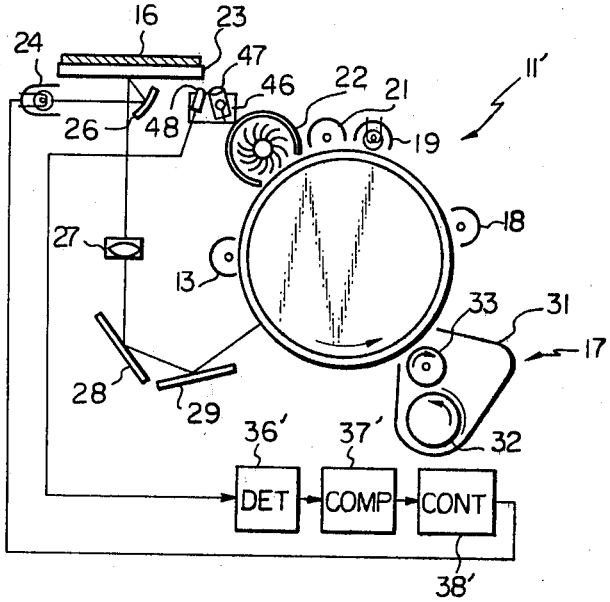
FIG. 6 is a schematic view of a second embodiment of the present invention.

FIG. 6 illustrates another embodiment of the present invention which is designated as 11'. Like elements are designated by the same reference numerals and corresponding but modified elements are designated by the same reference numerals primed.

In the copying machine 11' the electrosensor 34 is replaced by a photosensor 46 having a light source 47 for illuminating the document 16 and a photosensor element 48 for receiving light reflected from the document 16. A drive means (not shown) is provided to produce relative prescanning movement between the photosensor 46 and document 16 prior to scanning of the document 16 by the optical system 14. The prescanning may be performed at a much higher speed than the scanning movement of the optical system 14.

The photosensor 48 may comprise a single photosensor element in the manner of FIG. 4 or an array of photosensor elements in the manner of FIG. 5. A single photosensor element may be in the form of a CdS element having a diameter of 10 to 50 mm. An array may be embodied by an MOS line scanner such as manufactured by the Reticon company having photosensor elements linearly spaced at intervals of 25 microns.

The photosensor 48 senses the optical density of the document 16 directly and feeds an output to a detector 36'. A computer 37' connected to the output of the detector 26' determines whether the document 16 is a printed or photographic document in the same manner as the computer 37 and controls a controller 38' which applies a voltage to the lamp 24 which illuminates the document 16. The voltage applied to the lamp 24 is higher for a printed document than for a photographic document, thereby providing a higher intensity of illumination of a printed document.

Figure 7:
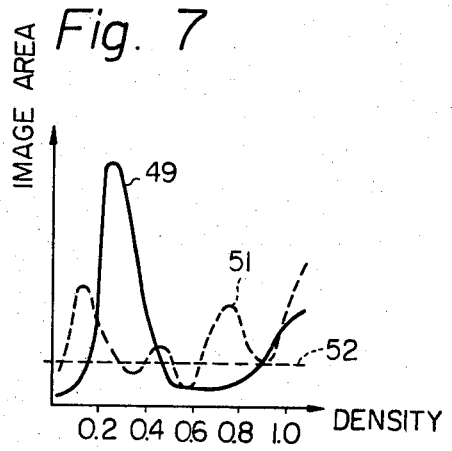
FIG. 7 is another graph illustrating the operation of the present invention.

FIG. 7 illustrates another criteria for determining whether the document 16 is a printed or photographic document. This criteria involves determining the number of different densities or density levels of the document 16. The document 16 is sensed on a point by point basis and the numbers of points having each density are counted. The result will give the areas of document 16 as a function of density. Generally, a printed document will have only two densities, black and white. However, a photographic document will have various shades of grey and therefore more than two different densities. A curve 49 for a printed document has only two peaks, one at about 0.25 corresponding to the background and another above 1.0 corresponding to the printed characters. However, a curve 51 for a photographic document has four peaks. The number of different densities corresponds to the number of peaks. Thus, the number of different densities may be obtained by counting the number of peaks above a predetermined value indicated at 52. The document 16 is determined to be a printed document if the number of peaks is below a predetermined number, such as two or three. The document 16 is determined to be a photographic document if the number of peaks is above two or three.

Figure 8:
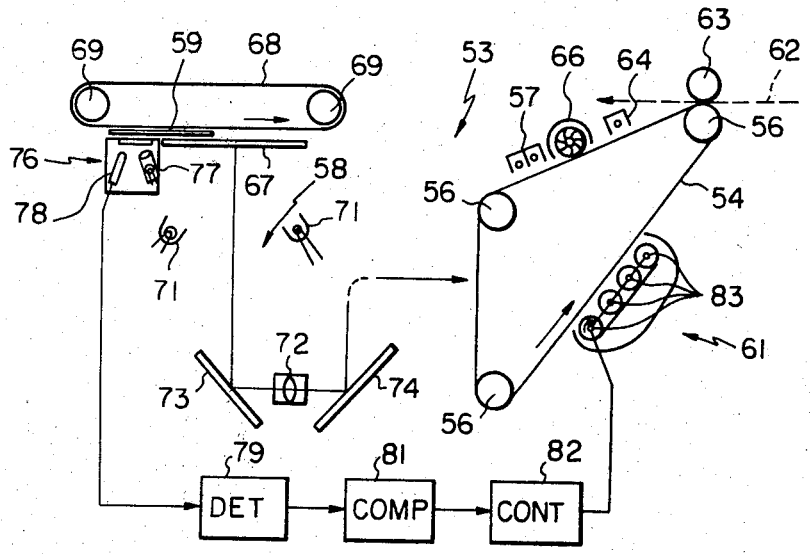
FIG. 8 is a schematic view of a third embodiment of the present invention.

FIG. 8 illustrates another electrostatic copying machine of the present invention which is generally designated as 53 and comprises a photoconductive belt 54 which is rotated counterclockwise at constant speed around rollers 56. The belt 54 is charged by a charging unit 57. An optical system 58 focusses a light image of an original document 59 onto the belt 54 to form an electrostatic image. A developing unit 61 applies toner to the belt 54 to produce a toner image which is transferred to a copy sheet 62 by means of a biased transfer roller 63. The belt 54 is discharged and cleaned by a discharge unit 64 and a cleaning unit 66 respectively.

The optical system 58 comprises a transparent platen 67. The document 59 is moved rightwardly over the platen 67 by a belt 68 which is trained around rollers 69. Lamps 71 illuminate a linear portion of the document 59 through the platen 67. A converging lens 72 focusses a light image of the portion of the document 59 onto the belt 54 via plane mirrors 73 and 74.

A photosensor 76 comprising a light source 77 and a photosensor element 78 is provided below the platen 67 upstream of the lamps 71 in the direction of movement of the document 59. The photosensor 76 senses the optical density of the document 59 before the imaging exposure. The output of the photosensor 76 is connected through a detector 79 to a computer 81 which determines whether the document 59 is a printed or photographic document using either of the criteria described above and computes a developing bias voltage as a function of the type of document and sensed optical density. The output of the computer 81 is fed to a controller 82 which controls the developing bias voltage applied to applicator rollers 83 of the developing unit 61 in the manner described above.

FIG. 9 illustrates another criteria for determining whether the document is a printed document or a photographic document. In this method, the proportion or percentage of dark image areas is computed. A curve 83 in FIG. 9 illustrates the probability that the percentage of dark image areas of a printed document will be a certain value, and is obtained through measurement of a large number of printed documents. A corresponding curve 84 is illustrated for photographic documents.

The curve 83 indicates that the percentage of dark image areas of a printed document is most probably 10%, with almost all printed documents having a percentage of less than 30%. The percentage of dark image areas of a photographic document is most probably 60%, with almost all photographic documents having a percentage of more than 30%. The method of FIG. 9 may be used by counting the number of sensed image points having a density of over, for example, 0.5 and dividing this number by the total number of sensed image points to obtain the percentage of dark image points or incremental areas. The document will be determined to be a printed document if the percentage is less than, for example, 30%, or a photographic document if the percentage is more than 30%.

FIG. 10 illustrates another electrostatic copying machine 86 embodying the present invention which comprises an optical system 87. A lamp 88 illuminates a linear portion of the document 16 through the platen 23. A light image of the linear portion of the document 16 is reflected from plane mirrors 89 and 91 to a converging lens 92. The image is converged by the lens 92, reflected back through the lens 92 from a half-mirror 93 and converged by the lens 92 again. The light image is reflected from the lens 92 by a plane mirror 94 onto the drum 12. The lamp 88 and mirror 89 are moved relative to the stationary platen 23 for scanning the document 16 at the same surface speed as the drum 12. The mirror 91 is moved also, but at one-half the speed of the drum 12.

Part of the light image is transmitted through the half-mirror 93 and focussed by a converging lens 96 onto a photosensor 97. The output of the photosensor 97 is fed through a detector 98 to a computer 99, the output of which is connected to control a controller 101. The photosensor 97 senses the intensity of the light image while it is being focussed on the drum 12 to form the electrostatic image. The computer 99 determines whether the document 16 is a printed document or a photographic document.

A developing unit 102 comprises a developing tank 103 for containing toner and first and second applicator rollers 104 and 106 for applying toner to the drum 12. The applicator rollers 104 and 106 have electrically conductive portions 104*a* and 106*a* and electrically insulative portions 104*b* and 106*b* respectively. The conductive portions 104*a* and 106*a* are axially spaced from the insulative portions 104*b* and 106*b* respectively. A voltage source 107 applies a bias voltage to the rollers 104 and 106.

When the computer 99 determines that the document 16 is a printed document, the controller 101 energizes a reversible motor 108 to move the insulative portions 104*b* and 106*b* of the rollers 104 and 106 into axial operative alignment with the drum 12 and further increase the gap between the rollers 104 and 106 and the drum 12 to a relatively large value. When the document 16 is determined to be a photographic document, the conductive portions of the rollers 104 and 106 are moved into operative alignment with the drum 12 and the gap between the rollers 104 and 106 and the drum 12 is reduced to a relatively small value.

FIG. 11 illustrates a computing circuit 110 which is applicable to the various embodiments of the present invention described above. The computing circuit 110 is capable of controlling the illumination lamp intensity, developing bias voltage, developing roller portion and gap. However, unnecessary elements are omitted according to the particular embodiment of the invention which is to be controlled.

The computing circuit 110 comprises a central processing unit (CPU) 111 which is connected to a read-only memory (ROM) 112 which contains the operating program for the circuit 110 and a random access memory (RAM) 113 for storing intermediate variables. The output of a sensor 114 which may be either an electrosensor or a photosensor is applied to the input of a detector 116 which produces an output proportional to the optical density of the document. The output of the detector 116 is fed through an analog-to-digital converter 117 to the CPU 111. The CPU 111 determines the type of document and bias voltage and feeds control signals through an input-output interface 118 and digital-to-analog converter 119 to the corresponding units for control.

An illumination lamp 121 for the original document is connected in series with a triac 122 across an AC source 123. The analog output of the converter 119 is applied to a unijunction transistor oscillator 123 which varies the voltage applied to the gate of the triac 122 and thereby the firing angle thereof. Typically, the oscillator 123 and triac 112 are constructed to operate using pedestal phase control. The earlier the triac 122 is rendered conductive in the AC cycle the longer electrical current will be passed through the lamp 121 and the greater the intensity of illumination of the document.

The output of the converter 119 is also connected to a controller 124 for the developing unit. In accordance with the input voltage the controller 124 will produce the appropriate developing bias voltage and also drive pulses for a motor 126 which positions the applicators of the developing unit. A precise gap may be obtained by feeding a controlled number of drive pulses to the motor 126.

Preferably, many of the component parts of the computing circuit 110 may be embodied by a single integrated circuit chip, such as the INTEL 8022 microprocessor which is commercially available as an off-the-shelf item at low cost.

In summary, it will be seen that the present invention overcomes the drawbacks of the prior art and provides a completely automatic copying machine which can produce excellent copies of both printed and photographic documents. The principles of the invention may be applied to types of electrostatographic apparatus other than copying machines such as facsimile transceivers having electrostatic printers.

Various modifications will become possible for those skilled in the art after receiving the teachings of the present disclosure without departing from the scope thereof.

What is claimed is:

1. An electrostatographic apparatus including a photoconductive member, imaging means for focussing a light image of an original document onto the photoconductive member to form an electrostatic image and developing means for developing the electrostatic image to form a toner image, characterized by comprising:

sensor means for sensing an optical density of the document;

computing means for receiving an output of the sensor means and determining whether the document is a printed document or a photographic document in accordance with a predetermined criteria; and control means for controlling a variable operating parameter of the apparatus in accordance with a first predetermined function of sensed optical density when the computing means determines that the document is a printed document or a second predetermined function of sensed optical density when the computing means determines that the document is a photographic document.

2. An apparatus as in claim 1, in which the variable operating parameter comprises an intensity of illumination of the document by the imaging means.

3. An apparatus as in claim 1, in which the variable operating parameter comprises a developing bias voltage of the developing means.

4. An apparatus as in claim 1, in which the sensor means comprises photosensor means for sensing an intensity of the light image.

5. An apparatus as in claim 4, in which the photosensor means comprises a photosensor having a photosensitive area smaller than the light image and means for producing relative movement between the light image and the photosensor.

6. An apparatus as in claim 5, in which the photosensor comprises a single photosensor element.

7. An apparatus as in claim 5, in which the photosensor comprises a plurality of photosensor elements.

8. An apparatus as in claim 1, in which the sensor means comprises electrosensor means for sensing the optical density of the document by sensing an electrostatic potential of the electrostatic image on the photoconductive member which corresponds to said optical density.

9. An apparatus as in claim 8, in which the electrosensor means comprises an electrosensor having an electrosensitive area smaller than electrostatic image and means for producing relative movement between the photoconductive member and the electrosensor.

10. An apparatus as in claim 9, in which the electrosensor comprises a single electrosensor element.

11. An apparatus as in claim 9, in which the electrosensor comprises a plurality of electrosensor elements.

12. An apparatus as in claim 1, in which the computing means is constructed to compute an average length of dark image areas and determine that the document is a printed document when the average length is less than a predetermined value and determine that the document is a photographic document when the average length is above the predetermined value.

13. An apparatus as in claim 1, in which computing means is constructed to compute a number of different image densities determine that the document is a printed document when the number of different image densities is below a predetermined number and determine that the document is a photographic document when the number of different image densities is above the predetermined number.

14. An apparatus as in claim 1, in which computing means is constructed to compute a proportion of dark image areas of the document and determine that the document is a printed document when the proportion is below a predetermined value and determine that the document is a photographic document when the proportion is above the predetermined value.

15. An apparatus as in claim 1, in which the computing means is constructed to compute a minimum density of the document and increase a developing bias voltage of the developing means as the minimum density increases.

16. An apparatus as in claim 15, in which the computing means is constructed to limit the bias voltage to a first predetermined value for a printed document and to limit the bias voltage to second predetermined value for a photographic document.

17. An apparatus as in claim 16, in which the first predetermined value is higher than the second predetermined value.

18. An electrostatographic apparatus including a photoconductive member, imaging means for focussing a light image of an original document onto the photoconductive member to form an electrostatic image and developing means for developing the electrostatic image to form a toner image, characterized by comprising:

sensor means for sensing an optical density of the document;

computing means for receiving an output of the sensor means and determining whether the document is a printed document or a photographic document in accordance with a predetermined criteria; and control means for controlling a variable operating paramenter of the apparatus in accordance with a first predetermined function of sensed optical density when the computing means determines that the document is a printed document or a second predetermined function of sensed optical density when the computing means determines that the document is a phtographic document;

the developing means comprising toner applicator means for applying toner to the photoconductive member, the variable operating parameter comprising a spacing between the applicator means and the photoconductive member.

19. An electrostatographic apparatus including a photoconductive member, imaging means for focussing a light image of an original document onto the photoconductive member to form an electrostatic image and developing means for developing the electrostatic image to form a toner image, characterized by comprising:

sensor means for sensing an optical density of the document;

computing means for receiving an output of the sensor means and determining whether the document is a printed document or a photographic document in accordance with a predetermined criteria; and control means for controlling a variable operating parameter of the apparatus in accordance with a first predetermined function of sensed optical density when the computing means determines that the document is a printed document or a second predetermined function of sensed optical density when the computing means determines that the document is a photographic document;

the developing means comprising applicator means for applying toner to the photoconductive member, the applicator means having an electrically insulative portion and an electrically conductive portion, the variable operating parameter comprising moving the applicator means so that the insulative portion is operatively adjacent to the photoconductive member for a printed document or the conductive portion is operatively adjacent to the photoconductive member for a photographic document.

* * * * *